US007448767B2

(12) United States Patent
Zhang

(10) Patent No.: US 7,448,767 B2
(45) Date of Patent: Nov. 11, 2008

(54) LIP PEN ASSEMBLY WITH LIGHT BULBS

(75) Inventor: Jun Zhang, Sijhih (TW)

(73) Assignee: Chuen Chern Co. Ltd., Jhonghe (TW)

( * ) Notice: Subject to any disclaimer, the term of this patent is extended or adjusted under 35 U.S.C. 154(b) by 229 days.

(21) Appl. No.: 11/521,945

(22) Filed: Sep. 15, 2006

(65) Prior Publication Data

US 2008/0068826 A1 Mar. 20, 2008

(51) Int. Cl.
*B43K 29/10* (2006.01)
*F21V 31/00* (2006.01)
*A46B 11/00* (2006.01)

(52) U.S. Cl. ..... 362/118; 362/136; 362/158; 401/129; 401/195

(58) Field of Classification Search ..... 362/118–120, 362/109, 158, 135, 136, 140, 267; 401/52, 401/126, 129, 195
See application file for complete search history.

(56) References Cited

U.S. PATENT DOCUMENTS 4,627,454 A * 12/1986 Dahm ..... 132/318
5,483,429 A * 1/1996 Chu ..... 362/118
6,036,332 A * 3/2000 Antal ..... 362/119
6,830,403 B2 * 12/2004 Tsai ..... 401/195
6,991,345 B2 * 1/2006 Helenowski ..... 362/137
7,090,420 B2 * 8/2006 De La Poterie et al. ..... 401/1
2007/0041177 A1 * 2/2007 Lin ..... 362/118

* cited by examiner

*Primary Examiner*—Alan Cariaso
(74) *Attorney, Agent, or Firm*—C. G. Mersereau; Nikolai & Mersereau, P.A.

(57) ABSTRACT

A lip pen assembly includes a container and a lip pen is removably inserted into the container. The lip pen has a base and a handle, the base is mounted to a neck extending from an end of the container and two light bulbs are connected to the base. A seal ring has a plurality of protrusions which extend through an end of the handle. The two light bulbs include two first poles and two second poles. A cover is removably connected to the base and has a biasing member which pushes a battery and the battery pushes the protrusions to be inserted into the base when the lip pen together with the base is removed from the container, so that the battery is in contact with the first terminals to light up the light bulbs.

8 Claims, 6 Drawing Sheets

LIP PEN ASSEMBLY WITH LIGHT BULBS

FIELD OF THE INVENTION

The present invention relates to a lip pen assembly with light bulbs which are activated when the lip pen is in use status and are turned off when the lip pen is received in the container.

BACKGROUND OF THE INVENTION

A conventional lip stick assembly is shown in FIG. 5 and generally includes a cover 20 and a lip stick assembly 21 wherein the cover 20 is mounted to the handle portion of the lip stick assembly 21 and the lip stick is received in the cover 20. A mirror 201 is connected to a side of the cover 20. Two holes 211 are defined in the lip stick assembly 21 so that two respective terminals 221 on two light bulbs 22 extend through the holes 211. A battery set 223 is connected with the two terminals 221 so that when the user's hand is in contact with the two terminals 221, the two light bulbs 22 are turned on so that the user can see her lips in the mirror 20 by the light provided by the light bulbs 22 in dark area. However, the two terminals 221 have to be in contact with the user's hand all the time during the period that the light bulbs 22 are in action, and this requirement limits the pose of the user's hand so that the user feel uncomfortable.

The present invention intends to provide a lip pen assembly with lights which are automatically turned on when the lip pen is removed from the container, and are turn off when the lip pen is inserted into the container again.

SUMMARY OF THE INVENTION

The present invention relates to a lip pen assembly that includes a container and a neck is connected to an end of the container through which a lip pen is inserted into the container. The lip pen has a base and a recess is defined in a first side thereof, the neck is inserted into the recess. A plurality of apertures are defined through a second side of the base. A shank of the lip pen is connected to the first side of the base and has an applying head on a distal end thereof. A seal ring is mounted on the shank and received in the recess of the base. A plurality of protrusions extend from the seal ring and movably extend through the apertures of the base. At least one light bulb extends through the base and has a first pole and a second pole. The first pole is located on the second side of the base. At least one battery has a first end contacting the second pole and a second end of the at least one battery is removably in contact with the first pole. A biasing member has a first end contacting the first end of the at least one battery and pushes the at least one battery toward the first pole. A second end of the biasing member is inserted into an opening of a cover and biases against an inner end of the cover. The cover is removably connected onto the base.

The primary object of the present invention is to provide a lip pen assembly with light bulbs which are automatically turned on when the lip pen is removed from the container and are turned off when the lip pen is inserted into the container.

Another object of the present invention is to provide a lip pen assembly with light bulbs wherein the user's hand is not restricted at a certain position when using the lip pen.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
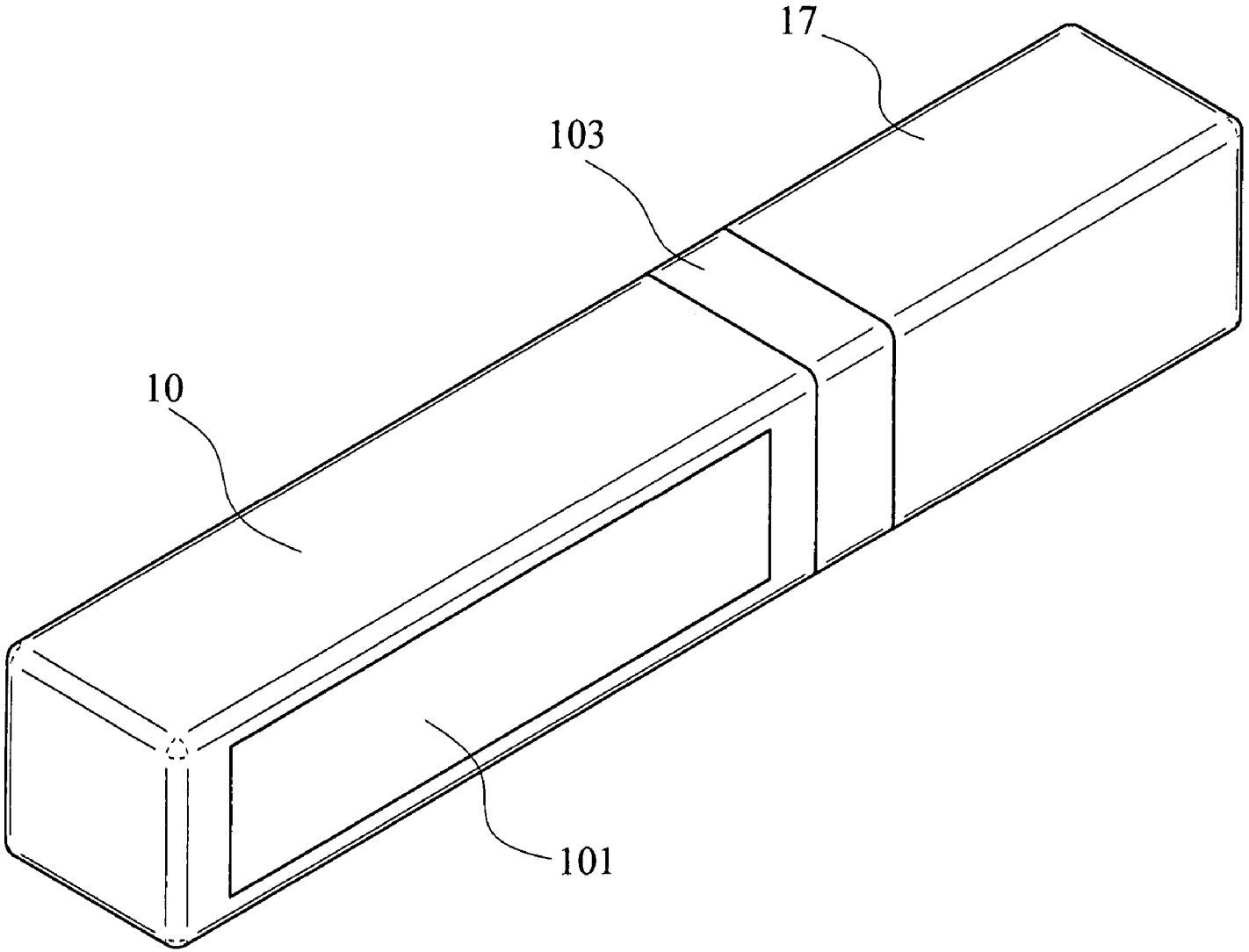
FIG. 1 is a perspective view to show the lip pen assembly of the present invention.
Figure 2:
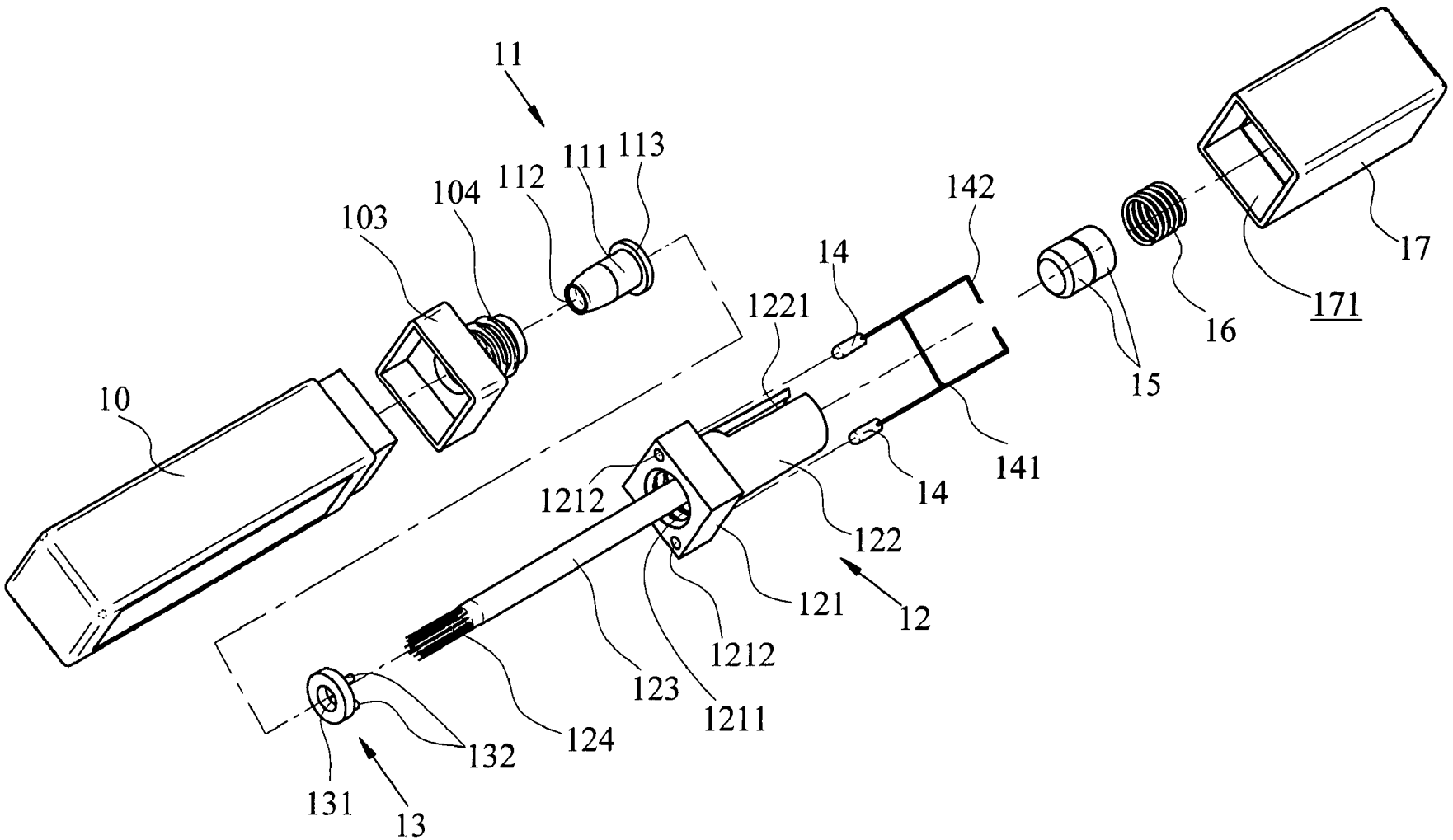
FIG. 2 is an exploded view to show the lip pen assembly of the present invention.
Figure 3:
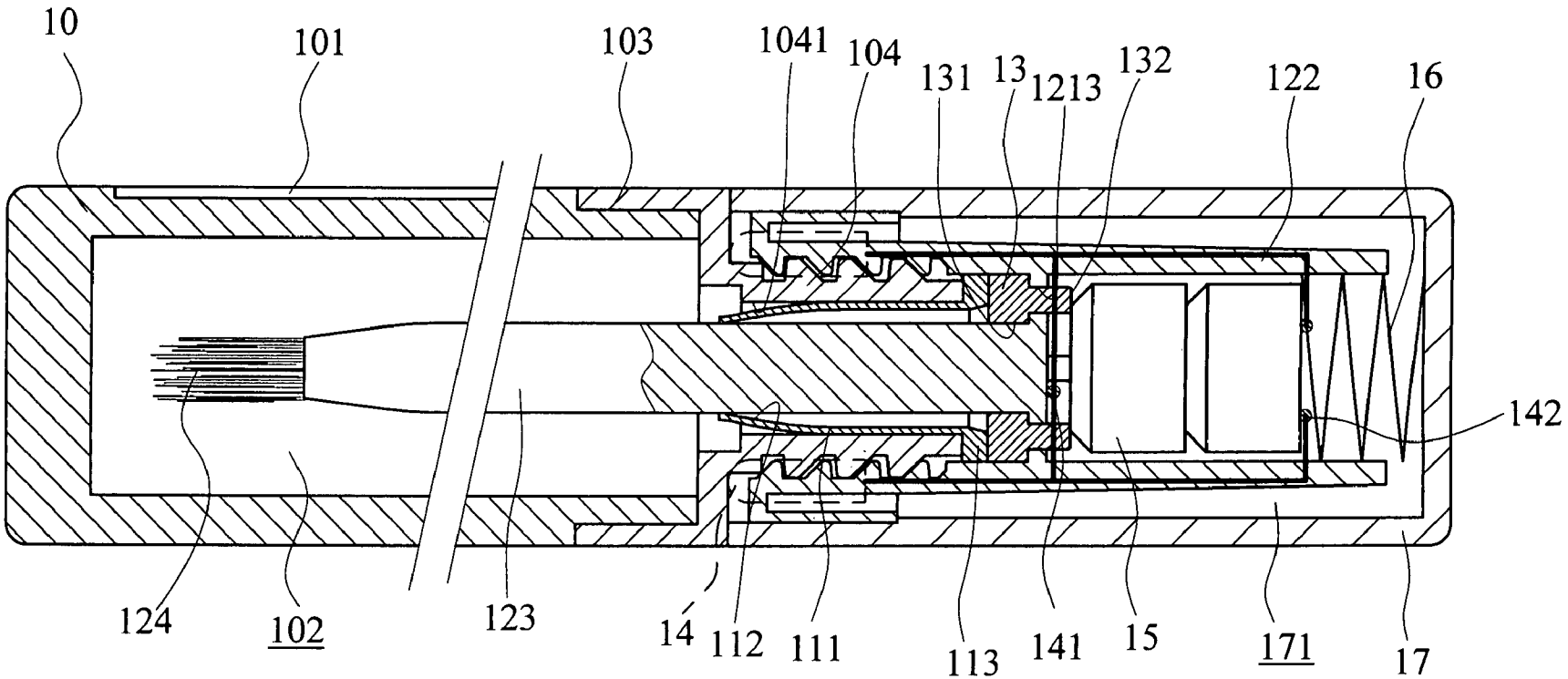
FIG. 3 is a cross sectional view to show that the lip pen is inserted into the container and the protrusions extend through the handle to disconnect the battery and the first poles of the light bulbs.

Referring to FIGS. 1 to 3, the lip pen assembly of the present invention comprises a container 10 having a space 102 defined therein and cosmetic product is received therein. A cap 103 is connected to an open end of the container 10 and a neck 104 extends from the cap 103. The neck 104 includes outer threads and a through hole 1041 is defined through the neck 104, the through hole 1041 communicates with the space 102 of the container 10. A rubber insertion 11 is inserted into the through hole 1041 of the neck 104 and includes an insertion body 111 and a passage 112 is defined axially through the insertion body 111. A flange 113 extends radially outward from an end of the insertion body 111 and contacts against an end of the neck 104. A mirror 101 is connected to an outside of the container 10.

A lip pen 12 has a base 121 and a handle 122 connected to the base 121. A recess 1211 is defined in a first side of the base 121 and includes inner threads. A shank 123 of the lip pen 12 extends from a center of the recess 1211. The neck 104 can be inserted into the recess 1211 in the base 121 by an engagement of inner threads in the recess 1211 and the outer threads on the neck 104, and the shank 123 is inserted through the through hole 1041 of the neck 104 and inserted into the space 102 in the container 10. An applying head 124 such as a brush is connected to a distal end of the shank 123. A plurality of apertures 1213 are defined through a second side of the base 121. A seal ring 13 has a central hole 131 and the shank 123 extends through the central hole 131. The shank 123 is received in the recess 1211 of the base 121. A plurality of protrusions 132 extend from the seal ring 13 and movably extend through the apertures 1213 of the base 121. The handle 122 has slits 1221 defined therein and the base 121 is located between the slits 1221. A plurality of receiving holes 1212 are defined through the base 121, Two light bulbs 14 extend through the base 121 and each have a first pole 141 and a second pole 142. The light bulbs 14 can be light emitting diodes. The first pole 141 is located on the second side of the base 121. A cover 17 is removably connected to the base 121 and has an opening 171. A biasing member 16 such as a spring and a battery unit 15 including two batteries is received in the cover 17. The battery unit 15 has a first end is biased by a first end of the biasing member 16 so that the battery unit 15 is pushed toward the first pole 141. A second end of the biasing member 16 is inserted into the cover 17 and biases against an inner end of the cover 17.

When the cover 17 is connected to the base 121 and the lip pen 12 is inserted into the container 10, the seal ring 13 is pushed by the neck 104 so that the protrusions 132 pushes the battery unit 15 to compress the biasing member 16 so that the first poles 141 of the light bulbs 14 are no in contact with the battery unit 15 as shown in FIG. 3.

Figure 4:
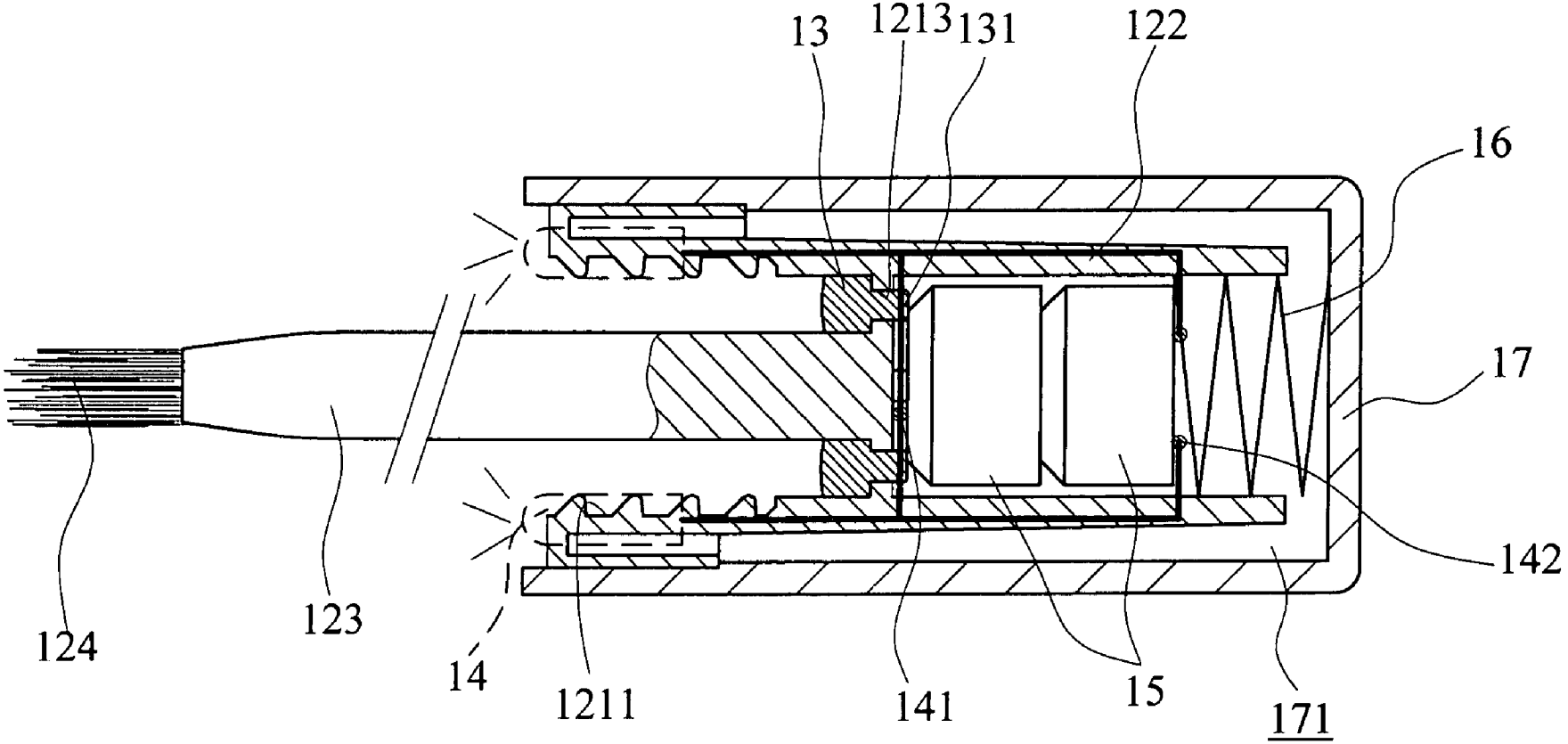
FIG. 4 is a cross sectional view to show that the lip pen is removed from the container and the protrusions are pushed by the battery which is then in contact with the first poles of the light bulbs.
Figure 4A:
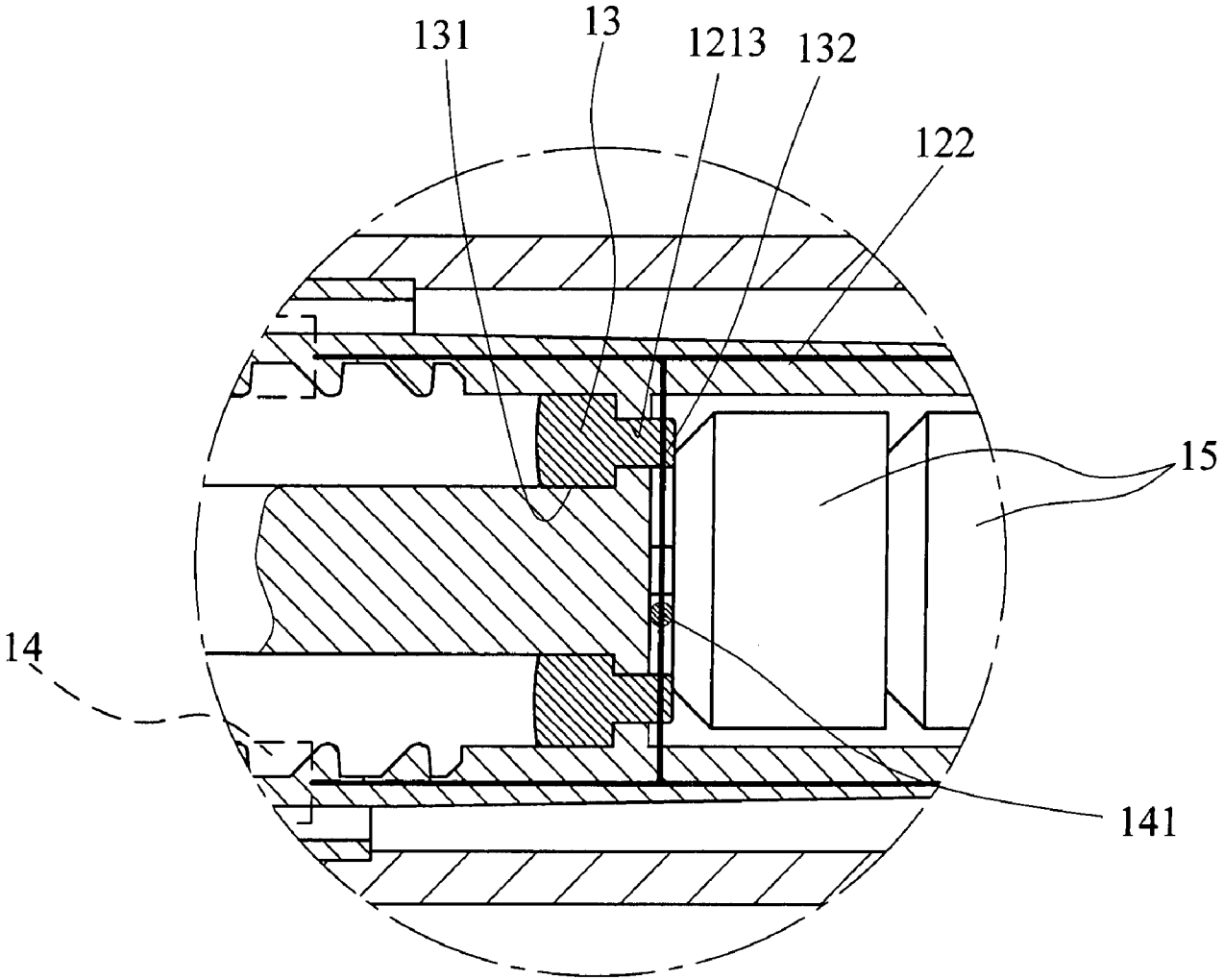
FIG. 4A is an enlarged view to show the status in FIG. 4.
Figure 5:
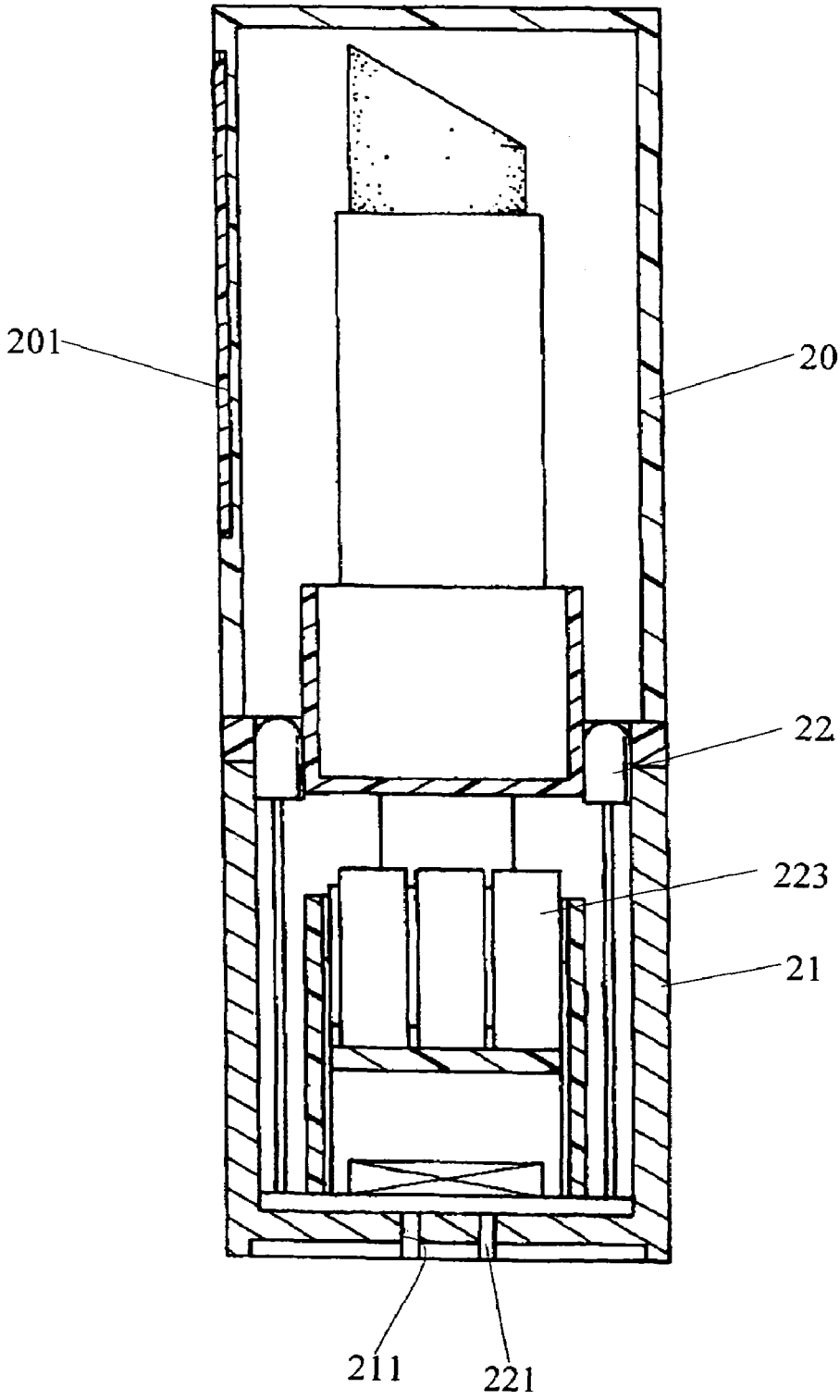
FIG.5 PRIOR ART
FIG. 5 is a cross sectional view to show a conventional lip stick assembly.

As shown in FIGS. 4 and 4A, when the user remove the cover 17 from the base 121 to pull the shank 123 of the lip pen 12 from the container 10, the neck 104 does not push against the seal ring 13 so that the protrusions 132 are pushed by the battery unit 15 and the biasing member 16, the battery unit 15 is then in contact with the first poles 141 so as to activate the light bulbs 14. When the cover 17 is connected to the base 121, and the shank 123 is inserted into the container 10 again, the seal ring 13 is pushed by the neck 104 and the protrusions 132 push the battery unit 15 to compress the biasing member 16 to disconnect the first poles 141 and the battery unit 15. The activation of the light bulbs 14 are controlled by the position of the neck 104 and the recess 1211 of the base 121 of the lip pen 12, so that the user can use the lip pen assembly without any limitation.

While we have shown and described the embodiment in accordance with the present invention, it should be clear to those skilled in the art that further embodiments may be made without departing from the scope of the present invention.

What is claimed is:

1. A lip pen assembly comprising:

a container having a space defined therein and a neck connected to an end of the container;

a lip pen having a base and a recess defined in a first side thereof, the neck inserted into the recess, a plurality of apertures defined through a second side of the base, a shank of the lip pen connected to the first side of the base and having an applying head on a distal end thereof;

a seal ring mounted on the shank and received in the recess of the base, a plurality of protrusions extending from the seal ring and movably extending through the apertures of the base;

at least one light bulb extending through the base and having a first pole and a second pole, the first pole located on the second side of the base;

at least one battery having a first end contacting the second pole and a second end of the at least one battery being removably in contact with the first pole, and a biasing member having a first end contacting the first end of the at least one battery and pushing the at least one battery toward the first pole, a second end of the biasing member inserted into an opening of a cover and biasing against an inner end of the cover, the cover removably connected onto the base.

2. The assembly as claimed in claim 1, wherein the container has a mirror connected to an outside thereof.

3. The assembly as claimed in claim 1, wherein the container is connected with a cap and the neck extends from the cap, the neck includes outer threads and a through hole is defined through the neck, the through hole communicates with the space of the container.

4. The assembly as claimed in claim 3, wherein a rubber insertion is inserted into the through hole of the neck and includes an insertion body and a passage is defined axially through the insertion body, a flange extends radially outward from an end of the insertion body and contacts against an end of the neck.

5. The assembly as claimed in claim 3, wherein a handle extends from the second side of the base and slits are defined in the handle, the base is located between the slits, a plurality of receiving holes are defined through the base, the recess includes inner threads which are engaged with the outer threads on the neck.

6. The assembly as claimed in claim 1, wherein the applying head is a brush.

7. The assembly as claimed in claim 1, wherein the at least one light bulb is a light emitting diode.

8. The assembly as claimed in claim 1, wherein the biasing member is a spring.

* * * * *